US007386263B2

(12) United States Patent
Stahuber

(10) Patent No.: US 7,386,263 B2
(45) Date of Patent: Jun. 10, 2008

(54) DEVICE AND METHOD FOR ELECTRICALLY CHARGING A TRANSPORT BELT USING A CONTACT LIP MADE OF A RUBBER MATERIAL

(75) Inventor: Markus Stahuber, Miesbach (DE)

(73) Assignee: Oce Printing Systems GmbH, Poing (DE)

( * ) Notice: Subject to any disclaimer, the term of this patent is extended or adjusted under 35 U.S.C. 154(b) by 64 days.

(21) Appl. No.: 11/441,987

(22) Filed: May 26, 2006

(65) Prior Publication Data

US 2006/0285888 A1 Dec. 21, 2006

(30) Foreign Application Priority Data

May 27, 2005 (DE) ..... 10 2005 024 380

(51) Int. Cl.
*G03G 15/20* (2006.01)
*G03G 15/01* (2006.01)

(52) U.S. Cl. ..... 399/313; 399/303

(58) Field of Classification Search ..... 399/302, 399/303, 308, 310, 313
See application file for complete search history.

(56) References Cited

U.S. PATENT DOCUMENTS 3,848,993 A * 11/1974 Hasiotis ..... 399/351
5,126,913 A 6/1992 Araya et al.
5,159,392 A 10/1992 Kasahara et al.
5,559,590 A 9/1996 Arai et al.
5,666,622 A 9/1997 Harasawa et al.
5,697,033 A * 12/1997 Ichikawa et al. ..... 399/310
5,713,066 A * 1/1998 Takekoshi et al. ..... 399/308 X
5,970,296 A * 10/1999 Takase ..... 399/310
6,188,862 B1 * 2/2001 Ishii ..... 399/313
6,266,500 B1 * 7/2001 Numagami et al. ..... 399/104
6,496,673 B2 * 12/2002 Bessho ..... 399/313 X

FOREIGN PATENT DOCUMENTS

DE 195 01 544 A1 7/1995
DE 102 47 368 A1 4/2004
DE 102 53 698 A1 5/2004
DE 10253698 * 5/2004
JP 11161058 A 6/1999
JP 2000-231288 A 8/2000
JP 2000321890 11/2000
WO WO 2004/046830 6/2004

* cited by examiner

*Primary Examiner*—Sandra L Brase
(74) *Attorney, Agent, or Firm*—Schiff Hardin LLP

(57) ABSTRACT

A device for electrically charging a transport belt for transport of recording media in a transfer printing area of an electrographic printer or copier as well as a method for charging. In a direction transverse to a running direction of the transport belt, a contact element is arranged bearing against the transport belt and via which electric charge is transferred to the transport belt, the contact element comprising a contact lip which is substantially comprised of a rubber material and which bears against the transport belt.

34 Claims, 6 Drawing Sheets

DEVICE AND METHOD FOR ELECTRICALLY CHARGING A TRANSPORT BELT USING A CONTACT LIP MADE OF A RUBBER MATERIAL

BACKGROUND

The present preferred embodiment relates to a device and a method for electrically charging a transport belt for the transport of recording media in the transfer printing area of an electrographic printer or copier. Further, the preferred embodiment relates to an associated contact element.

In electrographic printers or copying devices, the transfer of a toner image from an intermediate carrier, for example a photoconductor drum or a photoconductor belt, onto a recording medium is referred to as transfer printing. The section of the printer or copying device in which the intermediate carrier and the recording medium are brought into contact is referred to as the transfer printing area. In the transfer printing area, the intermediate carrier, for example the circumferential surface of a photoconductor drum, and the recording medium, move at the same speed in the same direction, while the toner is transferred from the intermediate carrier onto the recording medium.

A good print image on the recording medium can only be achieved if a uniform contact is established between the recording medium and the intermediate carrier in the transfer printing area. A good and uniform contact between the recording medium and the intermediate carrier can be achieved with the aid of an electrostatically chargeable transport belt on which the recording medium is transported through the transfer printing area in a manner that it rests on the transport belt and adheres thereto as a result of electrostatic forces.

A device for transferring a toner image with the aid of an electrostatically chargeable transport belt is illustrated in the document DE 102 47 368 A1, which is herewith incorporated by reference into the present application. In this device, the transport belt is charged with a charge whose sign is opposite to the sign of the charge of the toner image. This electrostatic charging of the transport belt has a double function: on the one hand, it results in an electrostatic attraction of the recording medium to the transport belt and thus in a safe guidance of the recording medium in the transfer printing area, and on the other hand, it causes the transfer of the toner image from the intermediate carrier onto the recording medium.

Similar devices having electrostatically charged transport belts are also known from the documents U.S. Pat. No. 5,666,622, DE 195 01 544 A1 and U.S. Pat. No. 5,159,392. In these three documents, the transport belt is charged either by means of corona arrangements, so-called corotrons, or by means of contact rollers. A corotron usually comprises one or several thin gold-coated tungsten wires, the electric potential of which with respect to a grounded housing amounts to several 1000 V so that the air surrounding these wires is ionized.

However, corotrons have a number of serious disadvantages, for example, the ozone formation as a result of the high charging voltage and the relatively complex replacement of worn corotron wires. In addition, the corotron wires are easily contaminated with dust, wear particles from the belt and toner particles, this resulting in an irregular charge distribution on the transport belt. Areas having a lower transport belt charge result in a less complete transfer of the toner onto the recording medium resting on the transport belt and thus in an undesired brighter print image. The cleaning of the corotron wires is not only complex but also exerts a considerable mechanical stress on these wires and shortens their life.

Contact rollers, too, have the disadvantage that they can easily be contaminated and thus cause an irregular charging of the transport belt. Furthermore, they cannot be directly arranged in the transfer printing area since they would disturb the uniform bearing of the recording medium against the intermediate carrier. In order to achieve that the transport belt is nevertheless sufficiently charged in the transfer printing area, a certain amount of current has to flow from the point of contact between the contact roller and the transport belt to the transfer printing area. Therefore, the conductivity of the transport belt must not be too low, which is a disadvantageous restriction on the choice of the transport belt material used.

From the documents DE 102 47 368 A1 and WO 2004/046830 A1, a device for electrically charging a transport belt is known, which device comprises a blade-like contact element comprising a plastic film, and in particular a polyimide film. Soot particles are embedded in the plastic film for lowering the conductivity of the film to a desired value.

The known contact element made of plastic film can be directly arranged in the transfer printing area on the side of the transport belt facing away from the intermediate carrier and thus provides a reliable uniform charging of the transport belt in the transfer printing area. Since the transport belt continuously rubs against the contact element, the same is constantly cleaned.

However, this known blade-like contact element has disadvantages, too. On the one hand, the known blade-like contact elements are relatively expensive to produce. Their specific conductivity must be exactly adapted to the transfer printing system used so that good charging and transfer printing results can be achieved. This means that the plastic films must be specifically produced which is only economic for larger batches which are not required. In addition, it turned out to be difficult to establish a truly homogeneous distribution of the conductivity within the film, this having negative effects on the transfer printing.

Further, the known blade-like contact elements have to be installed very precisely, in particular with a very narrow fitting tolerance with respect to the distance to the transport belt. If the transport belt runs horizontally in the transfer printing area, as is usual, this means that the known blade-like contact element has to be installed with a very tight vertical tolerance, which is complicated both when the known contact element is installed as well as when the same is maintained or replaced and causes considerable costs. If the known contact element is installed at too great a distance from the transport belt, there results an uncertain electrical contact between the contact element and the transport belt. However, if the known contact element is installed too close to the transport belt, it is bent upon contact with the transport belt and thus exerts a pressure force on the transport belt. However, an increased pressure force is not desired since it results in a so-called mechanical transfer printing in which a toner background present on the photoconductor is transfer printed onto the recording medium by the mechanical pressure force.

SUMMARY

It is an object to specify a device and a method for charging the transport belt which, at lower costs, achieve the same or better transfer printing results than is the case in the prior art mentioned.

A device and a method is provided in which in a direction transverse to the running direction of the transport belt a contact element bearing against the transport belt is arranged, via which contact element electric charge is transferred onto the transport belt, the contact element comprising a contact lip which substantially comprises a rubber material and bears against the transport belt.

DESCRIPTION OF THE PREFERRED EMBODIMENT

Figure 1:
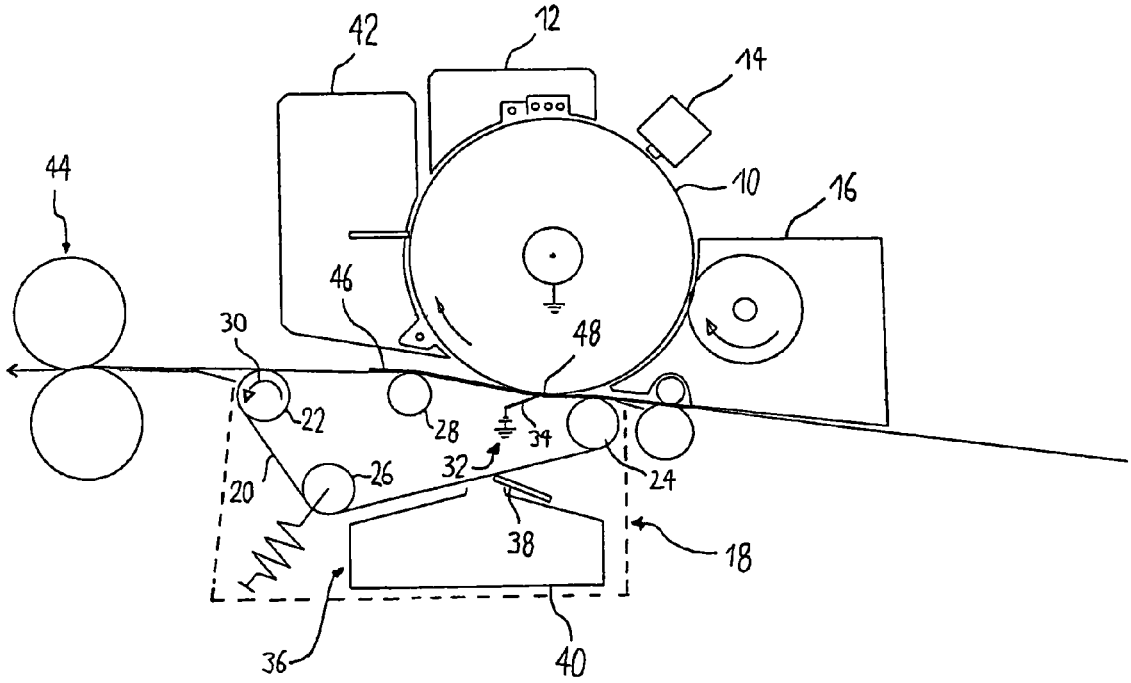
FIG. 1 is a schematic illustration of the components of an electrographic printer or copier involved in image formation.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

The information that the contact lip is "substantially" comprises of a rubber material means that a rubber material forms the main part of its material but that, in addition, fillers and the like can be added, with which the electrical and mechanical properties of the material can be influenced. The contact lip made of rubber material can be produced in a considerably easier and more cost-efficient way than the plastic films known from the prior art. On the one hand, this can be put down to the more cost-efficient raw materials and, on the other hand, to the considerably easier production process for the rubber lips which can be produced by casting. Moreover, in the case of the contact lip made of a rubber material, a homogeneous distribution of fillers for lowering the specific volume resistivity can be achieved more easily. As a result, the resistivity of the contact lip as a whole can be set more precisely than in the case of the known plastic blades, and there will be lower spatial fluctuations in the specific conductivity, i.e. a more homogeneous distribution of conductivity.

Another advantage of the rubber material is that it is far more flexible than a plastic film. Therefore, with the same pressure force, far greater fitting tolerances can be compensated for than this would be possible with a plastic film.

The preferred embodiment can advantageously be used in electrographic printing or copying devices whose recording methods for image formation are in particular based on the electrophotographic, magnetographic or ionographic recording principle. Further, the printing or copying devices can make use of a recording method for image formation in which an image recording medium is electrically controlled point-by-point either directly or indirectly. The preferred embodiment is, however, not restricted to such electrographic printing or copying devices.

In FIG. 1, the components of an electrographic printer involved in the image formation are schematically illustrated. FIG. 1 shows a photoconductor drum 10, the circumferential surface of which is coated with a photo-semiconductor, for example arsenic triselenide ($As_2Se_3$). Further, FIG. 1 illustrates a charging corotron 12 for charging the photo-semiconductor layer of the photoconductor drum 10, a character generator 14 for exposing the photo-semiconductor layer in order to generate a latent charge image thereon, and a developing unit 16 for developing the latent charge image with charged toner particles.

Further, a paper transport aggregate 18 is schematically illustrated in FIG. 1 by means of a box illustrated in broken lines. The paper transport aggregate 18 comprises a transport belt 20 which is guided around a first roller 22, a second roller 24, a tension roller 26 and a roller 28 for pressing the belt outwardly so that the belt bears against the photoconductor drum 10 in a nip area and at least in part wraps round the photoconductor drum. The transport belt 20 is driven by the first roller 22 in the direction identified by the arrow 30. Further, the paper transport aggregate 18 comprises a device 32 for electrically charging the transport belt 20, said device only being schematically illustrated in FIG. 1. The device 32 comprises a contact element 34 which is arranged transversely to the running direction of the * transport belt 20 and bears against the transport belt. Finally, the paper transport aggregate 18 comprises a cleaning unit 36 having a scraping blade 38 for scraping off toner particles from the transport belt 20 and a toner collecting tank 40 for collecting the toner that has been scraped off.

Further, a cleaning unit 42 for cleaning the photoconductor drum and a fixing unit 44 for fixing the toner image on the paper are shown in FIG. 1. More detailed information on the function of the listed elements of FIG. 1 can be found in the above-mentioned document DE 102 47 368 A1 and shall not be repeated here.

The transport belt 20 serves for the transport of a recording medium, which is likewise shown in FIG. 1, here a sheet of paper 46, through the transfer printing area 48 in which the sheet of paper 46 is pressed against the photoconductor drum 10. The transport belt 20 is charged by means of the device 32 with a charge that is opposite to the charge of the toner particles. The electrostatic charge of the transport belt 20 guarantees a safe hold of the sheet 46 on the transport belt and serves for the transfer of the toner particles from the photoconductor drum 10 onto the sheet 46.

As can be taken from the schematic illustration of FIG. 1, the contact element 34 contacts the transport belt 20 in the transfer printing area on the side facing away from the photoconductor drum 10 (the underside in the illustration of FIG. 1). This means that the electric charge is transferred onto the transport belt 20 exactly where needed. Since during the transfer of the toner from the photoconductor drum 10 onto the sheet 46 an electric current flows from the transport belt 20 to the photoconductor drum 10. Because the contact element 34 is arranged in the transfer printing area 48, this current does not have to flow to the transfer printing area 48 in the longitudinal direction of the transport belt 20.

The paper transport aggregate 18 is designed for a high-performance printer and operates at a processing speed of more than 0,3 m/s, preferably 0,34 m/s±1 m/s, i.e. the transport belt 20 is moved at a circulation speed of at least 0,3 m/s. Given such high circulation speeds, it is not easy to guarantee a firm hold of the recording medium 46 on the transport belt 20. This has to be put down to the fact that given a higher transport belt speed a higher current flow from the contact element 34 onto the transport belt 20 is required in order to electrostatically charge the transport belt 20 with sufficient charge. Therefore, some known paper transport aggregates have a precharging roller arranged upstream of the contact element 34 as viewed in the circulation direction, as this is known, for example, from the document US 2002/057933 A1. This solution is, however, disadvantageous since it makes a compact construction impossible.

In the device for electrically charging the transport belt 20 illustrated in FIG. 1, it is, however, possible to achieve a sufficient electrostatic charging of the transport belt 20 despite high processing speed. This can be put down on the one hand to the specific volume resistivity of the transport belt 20, which preferably lies between $10^{11}$ and $10^{13}$ Ωcm and is thus lower than in many known devices. Another important role in the device for electrically charging the transport belt 20 plays the structure and the arrangement of the contact element 34 which will be described in every detail below.

The relatively strong adherence of the recording medium 46 to the transport belt 20, which is necessary for a safe guidance in the transfer printing area 48, makes the shearing off of the recording medium from the transport belt 20 at the end of the transport path, i.e. in the area of the first roller 22, more difficult. This problem occurs in particular in the case of recording media having a low rigidity, for example paper having a low weight per unit area and short fibers, which does not shear off well from the intermediate carrier and thus often cannot be used in conventional printers and copying devices. This represents a great disadvantage since especially cost-efficient recording media usually have a low rigidity.

In order to enable the shearing off of the recording medium 46 from the transport belt 20 even given a low rigidity, the first roller 22 is formed antistatically with a volume resistivity between $10^5$ and $10^9$ Ωcm. This means that it can bleed off a considerable part of the charge from the transport belt 20 in the area of the first roller 22 so that the adherence between the recording medium 46 and the transport belt 20 is reduced and the shearing off is made easier. Further, the first roller 22 preferably has a relatively small diameter of 20 to 30 mm, which makes the shearing off of the recording medium 46 from the transport belt 20 in the area of the first roller 22 easier.

By way of these techniques, recording media of an extremely large range of weights per unit area ranging from 60 g/m$^2$ up to 200 g/m$^2$, can, at a high circulation speed of the transport belt 20 of 0,3 m/s or more, on the one hand, be safely guided through the transfer printing area 48 and, on the other hand, be reliably removed at the end of the transport path, i.e. in the area of the first roller 22, from the transport belt 20.

Figure 2:
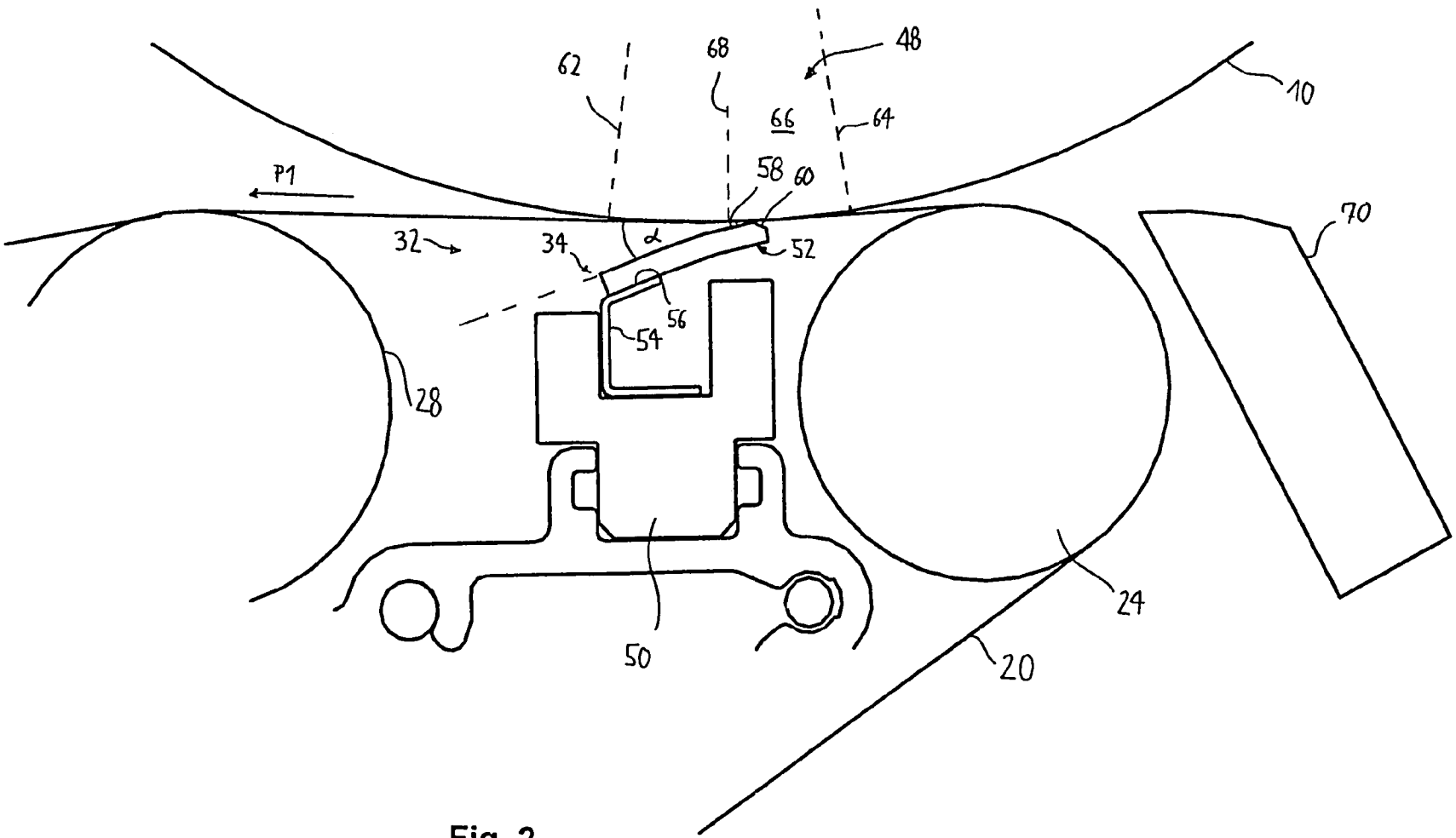
FIG. 2 is an enlarged schematic illustration of a device for charging a transport belt.

In. FIG. 2, a detailed view of the device 32 for electrically charging the transport belt 20 is shown. As illustrated in FIG. 2, the device 32 comprises a mounting 50 which is arranged in the printer or copier, or in the paper transport aggregate 18, and the above-mentioned contact element 34 which comprises a contact lip 52 and a conductive support element 54.

The contact lip 52 has a mounting section 56 for mounting on the conductive support element 54, and a contact section 58 for contact with the transport belt 20.

The contact lip 52 is arranged in a "butt-joint" manner, i.e. it is inclined against the running direction of the transport belt 20 which is indicated by the arrow P1. The angle of inclination a between the contact lip 52 and the transport belt 20 amounts to 15° to 45°, preferably 20° to 30°. At the contact section 58, a chamfered edge 60 is formed.

In FIG. 2, the so-called nip area 48, in which the transport belt 20 bears against the photoconductor 10 is identified by the radial broken lines 62 and 64, which delimit the nip area 48. Between the radial broken line 64 and a radial broken center line 68, there is a front half 66 of the nip area 48. The "front half" 66 of the nip area 48 is the upstream half of the nip area with respect to the running direction of the transport belt 20 (direction of the arrow P1). The contact lip 52 is arranged such that it contacts the photoconductor 10 in the front half 66 of the nip area 48.

The contact lip 52 is made of a rubber material, preferably of a synthetic rubber, in particular of nitrile butadiene rubber (NBR). The rubber material has a hardness of 35 to 55 ShoreA, preferably a hardness of 40 to 50 ShoreA. The rubber material can likewise be formed by silicone or chloroprene rubber which both have advantageous processing properties.

Conductive particles for lowering the specific volume resistivity of the material are added to the rubber material of the rubber lip 52. In the embodiment of FIG. 2, the volume resistivity of the contact lip 52 amounts to $4\times10^7$ Ωcm, measured when a voltage of 1000 volts is applied. A preferred range for the specific volume resistivity lies between $10^4$ to $10^9$ Ωcm, and the range between $10^6$ and $10^8$ Ωcm turned out to be particularly advantageous.

The absolute resistivity of the contact lip 52, i.e. the resistivity between the mounting section 56, via which the charge is supplied to the contact lip, and the contact section 58, via which the charge is given off to the transport belt 20, amounts in the embodiment illustrated to 3 MΩ, measured at a current flow of 100 μA. According to experiences of the inventor, this absolute electrical resistivity preferably amounts to between 1 and 10 MΩ, in particular preferably between 2 and 4 MΩ, measured again at a current flow of 100 μA.

When a weight force having a weight of 100 g is applied to the contact lip 52, a deflection of 0.3 to 0.5 mm, preferably 0.4 to 0.48 mm should be achieved, the contact lip 52 having a width of 315 mm and a free length of 7 mm as well as a thickness of 1.5 mm. In the operating state, the contact lip 52 is pressed against the inside of the transport belt 20 with a force corresponding to a weight force having a weight in the range between 20 g and 300 g, preferably between 50 g and 150 g, and in particular of 100 g. This corresponds to a total force in the range between 0.1962 N and 2.943 N, preferably between 0.4905 N and 1.4715 N, and in particular of 0.981 N.

The device 32 of FIG. 2 differs from the devices of the above-mentioned documents DE 102 47 368 A1 and WO 2004/046830 A1 in two basic aspects. The one aspect relates to the material which for the contact element known from the cited prior art is comprised of polyimide, while in the present preferred embodiment a rubber material having the mechanical and electrical properties described is used for the contact lip 52. The second aspect relates to the arrangement of the contact element 34 with respect to the transport belt 20, which in the cited prior art is arranged in a rubbing manner, here, however, in a butt-joint manner. In the following, the advantages and effects of the differences in these two aspects over the prior art are explained.

On the one hand, the rubber lip 52 with its desired mechanical and electrical properties can be produced considerably easier and in a more cost-efficient way than the plastic films from which conventional contact elements are produced. Known contact blades made of plastic, for example polyimide, result in relatively high costs due to expensive raw materials and an expensive production process. Typically, soot particles are embedded -into the film in order to lower its conductivity to a desired volume resistivity. The production of such precisely specified plastic films is only economic for amounts which are far beyond the demand. Further, it has turned out to be difficult to establish a homogeneous distribution of the conductivity within the film.

In contrast thereto, rubber lips, such as the illustrated rubber lip 52 comprising fillers for establishing the desired electrical conductivity can easily and cost-efficiently be produced by casting. A granulate of the rubber material can thoroughly be mixed with the fillers before it is cast into the shape of the contact lip 52 so that a homogeneous distribution with respect to the specific volume resistivity can be achieved. Moreover, by casting processes, any shapes, even those having undercuts can be produced so that both the contact section 58 as well as the mounting section 56 can be formed in any desired shape. Examples of other shapes for these sections are described in more detail with reference to FIGS. 3 and 4.

A further advantage of the rubber material is that it is more flexible than a plastic film. In contrast to a contact blade made of plastic, the rubber contact lip 52 can be bent to a greater extent when it is applied to the transport belt 20 without an excessive pressure force being exerted on the transport belt 20. Thus, the rubber lip 52 can compensate for a considerably greater vertical fitting tolerance given the same or even a lower pressure force on the transport belt 20, this reducing both the costs for the manufacture as well as for the maintenance. The contact pressure which is exerted on the transport belt 20 by the rubber lip 52 shall only be as high as required to establish a safe electrical contact between the contact lip 52 and the transport belt 20. Any pressure beyond this limit is undesired since it results in a so-called mechanical transfer printing in which a toner background which may remain on the photoconductor 10 despite a cleaning by the cleaning device 42 is transfer-printed onto the recording medium 46 by means of the mechanical pressure force.

In this connection the shore hardness of the rubber material is an essential functional parameter. It has to be selected such that a balance is found between smaller pressure forces on the one side and a necessary restoring force in the free section of the contact lip 52 in order to always establish a good contact between the contact lip 52 and the transport belt 20 even when fitting tolerances are taken into account.

As a result of the good contact which can be established between the rubber lip 52 and the transport belt 20 and the very good homogeneity of the conductivity of the rubber material, the voltage which has to be applied to the conductive support element 54 for charging the transport belt 20 could be considerably reduced compared with a device having a plastic film. In the embodiment of FIG. 2, a charging voltage of some 100 volts is sufficient in order to generate a current flow of 100 μA onto the transport belt 20. Given such low charging voltages, the ozone formation is so little that an ozone filter can be dispensed with. The high voltage power required for charging could be reduced by 50% compared with an embodiment using a contact blade made of polyimide. Moreover, the service life of the rubber lip 52 is about one and a half times as long as a contact element made of polyimide.

The second important difference of the device 32 over the cited prior art is that the contact lip 52 is arranged in a butt-joint manner, i.e. is inclined against the running direction of the transport belt. This arrangement offers two advantages over the rubbing arrangement. On the one hand, the angle of inclination a between the contact lip 52 and the transport belt 20 can be chosen smaller than in the case of a rubbing arrangement, for example between 20° and 30°. A flat angle of inclination of the contact lip 52 with respect to the transport belt 20 has an advantage insofar as a relatively high fitting tolerance with a relatively low deformation of the contact lip and thus relatively low fluctuations in the contact pressure can be compensated for. In the case of a rubbing arrangement, however, such flat angles of inclination cannot be chosen since the frictional force between the transport belt and the rubbing contact element opposes the contact pressure. Thus, in the case of a rubbing arrangement, the necessary contact can no longer be established given flat angles of inclination. With a butt-joint arrangement of the contact element 34, as illustrated in FIGS. 1 and 2, the same frictional force has the effect that the contact lip 52 is erected, i.e. it increases the contact between the contact lip 52 and the transport belt 20. For this reason, flatter angles of inclination can be implemented given butt-joint arrangements.

On the other hand, the butt-joint arrangement allows that the contact lip 52 bears against the transport belt 20 in the front half 66 of the nip area 48. What is achieved thereby is that the transport belt 20 is already charged when entering the transfer printing area or nip 48, which results both in a better electrostatic transfer printing as well as in a safer guidance of the recording medium 46 on the transport belt 20. A charging in the front half 66 of the nip area 48 is the more important the higher the processing speed of the printer or copier.

As can be taken from FIGS. 1 and 2, in the case of a rubbing arrangement of the contact lip 52 it would hardly be possible to establish a contact of the contact lip 52 in the front half 66 since for this purpose the second roller 24 would have to be displaced to the right in the illustration of FIGS. 1 and 2. However, for reasons of space, this is hardly possible since the paper transport aggregate 18 should be designed as compact as possible, and the distance between the second roller 24 and the roller 28 should possibly not be increased in order to guarantee a safe guidance of the belt even at a high belt running speed. In addition, when displacing the second roller 24 to the right, a toner mark sensor 70 which is required to control the development of a test toner mark, would have to be displaced, which is not readily possible. For these reasons, the butt-joint arrangement of the contact lip 52 makes it easier to establish a contact between the contact lip 52 and the transport belt 20 in the front half 66 of the nip area 48.

Figure 4:
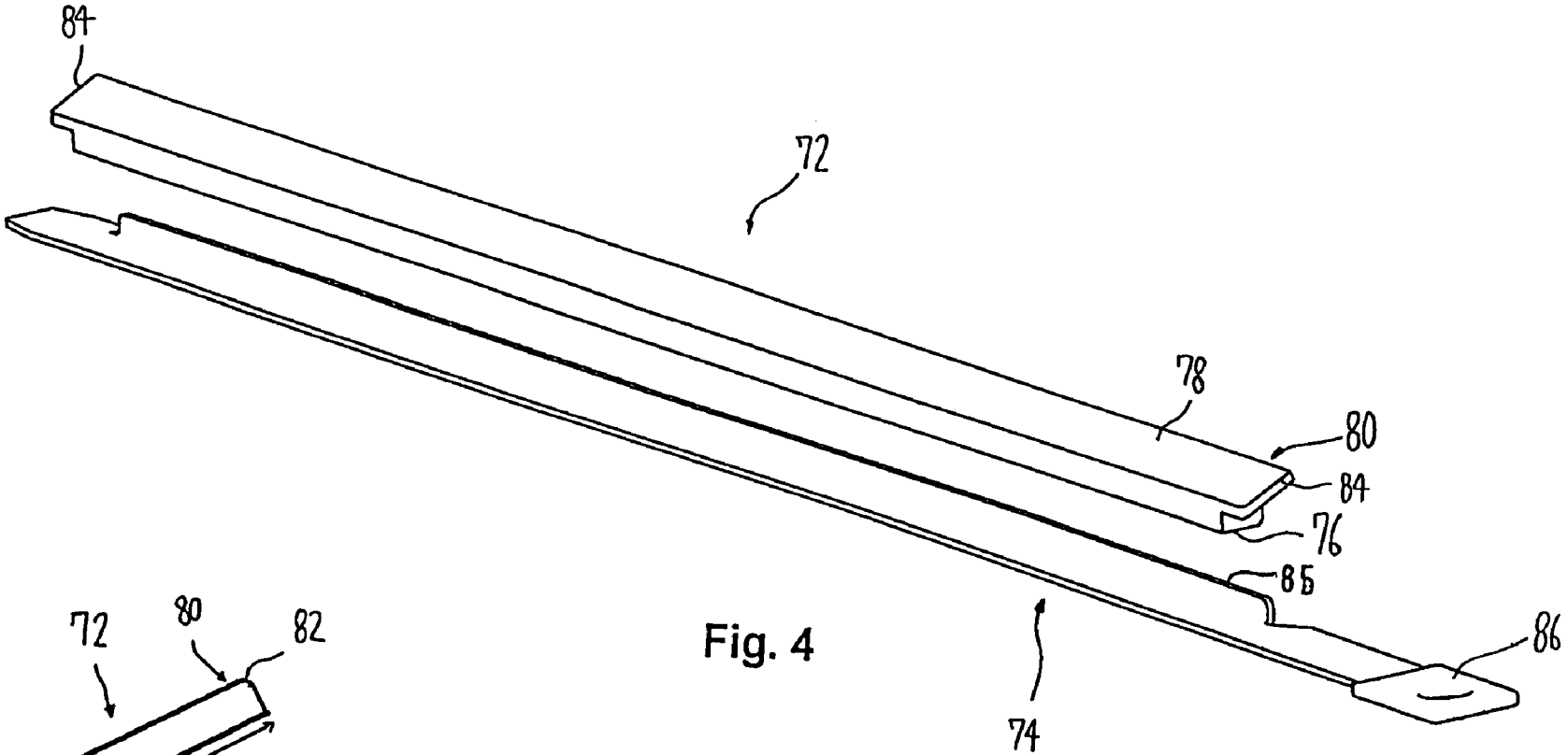
FIG. 4 is a perspective view of the contact lip of FIG. 3 and of a conductive support element.
Figure 3:
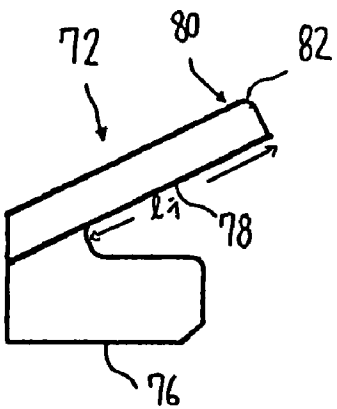
FIG. 3 is a side view of a contact lip.

FIG. 3 is a side view of a further embodiment 72 of a contact lip, and FIG. 4 is a perspective view of this contact lip 72 and a further embodiment 74 of a conductive support element. The contact lip 72 has a mounting section 76 with which it is adhered to the conductive support element 74 by means of conductive adhesive. The contact lip 72 further has a free lip section 78, at the free end of which the contact section 80 is formed. The contact section 80 has a rounded edge 82 having a radius of curvature of 0.5 mm. The rounded edge 82 functionally corresponds to the chamfered edge 60 of FIG. 2. They both serve to prevent that the contact lip 52 or 72 gets stuck on the transport belt 20 and bends over.

The length $l_1$ (see FIG. 3) of the free lip section 78 preferably amounts to between 5 and 10 mm.

As can be seen in FIG. 4, the free lip section 78 is longer than the mounting section 76 as viewed in the longitudinal direction of the contact lip 72. In other words, the longitudinal ends 84 of the contact section 80 protrude beyond the mounting section 76. A lower voltage is applied at these protruding longitudinal ends 84 due to the greater distance to the conductive support element 74, as a result whereof sparking can be avoided. This is a decisive advantage since sparking can melt toner which might adhere on the transport belt 20 or the photoconductor 10 and can no longer be removed by the respective cleaning devices 36 or 42.

The conductive support element 74 is formed by sheet steel having a bent section 85. On one end of the support element 74, a handle 86 is arranged by means of which it can be grasped when it is inserted into a mounting 88 (see FIGS. 6 to 10 below) or taken out therefrom.

Instead of gluing the contact lip 72 to the support element 74, it can likewise be secured on the support element 74 by means of vulcanization. This is more cost-efficient and will last longer since a glue connection is subject to aging processes and can limit the life of the contact elements as a whole. In an advantageous development, clamping structure (not shown) can likewise be provided on the support element by means of which at least part of the mounting section or the mounting section of the contact lip can be clamped. Alternatively, a hollow profile section can be formed on the conductive support element, and the mounting section of the contact lip can be formed such that it can be inserted into the hollow profile section.

Figure 5:
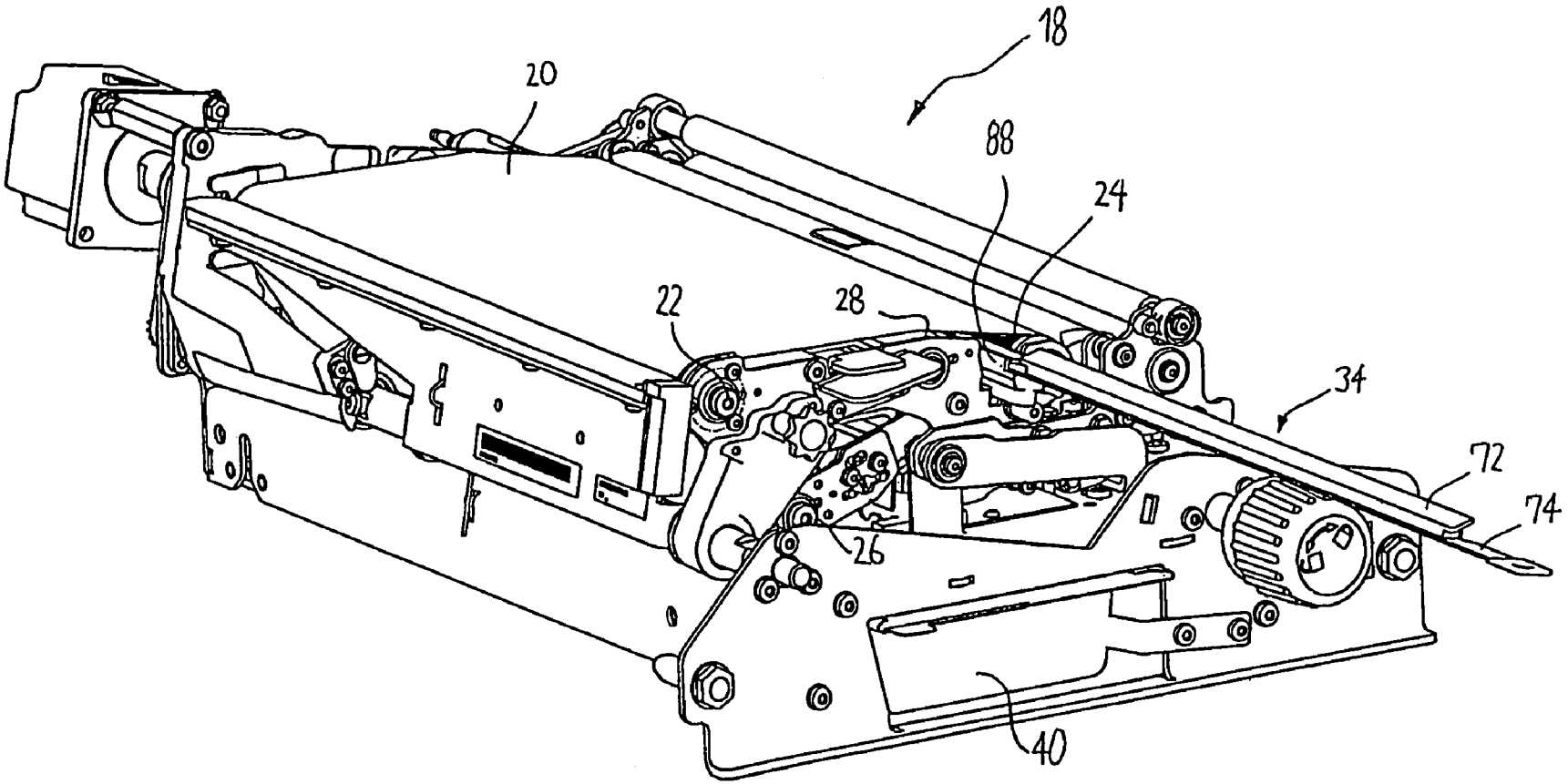
FIG. 5 is a perspective illustration of a paper transport aggregate for a printer or copier, in which the conductive support element of FIG. 4 is pulled out together with the contact lip mounted thereon.

In FIG. 5, the paper transport aggregate 18 which is only schematically illustrated in FIGS. 1 and 2 is shown in a perspective illustration. One sees the transport belt 20 described in connection with FIG. 1, the first roller 22 (or respectively its axis), the second roller 24, the tension roller 26 (or respectively its axis), the roller 28 and the toner collecting tank 40. Further, the contact element 34, which is only schematically illustrated in FIGS. 1 and 2, is shown which comprises the contact lip 72 described in connection with FIGS. 3 and 4 as well as the conductive support element 74 described in connection with FIG. 4. In the paper transport aggregate 18 and thus in the printer or copier, a mounting 88 is arranged into which the contact element 34 can be inserted or from which the contact element 34 can be removed. In this way, the contact element 34 can easily and without complication be taken out of the printer or copier for cleaning purposes. As being a wearing part, it can also be easily replaced even by an untrained person.

Figure 6:
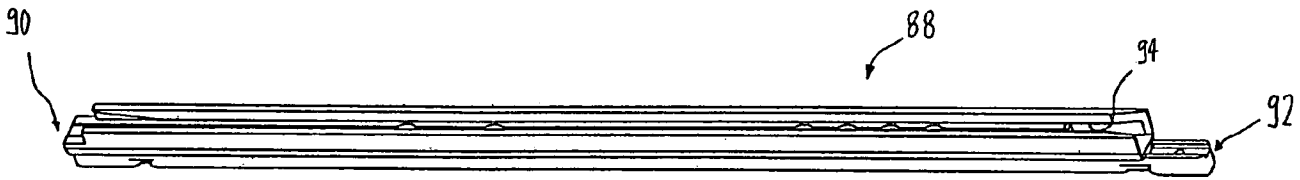
FIG. 6 is a perspective view of a mounting into which the conductive support element of FIG. 4 can be inserted.
Figure 7:
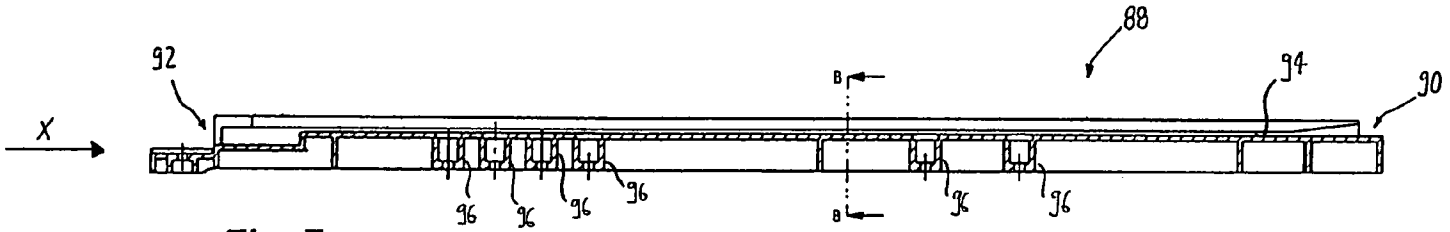
FIG. 7 is a longitudinal section of the mounting of FIG. 6.
Figure 8:
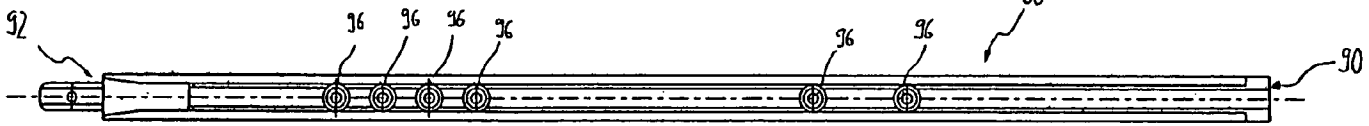
FIG. 8 is a top view of the mounting of FIG. 6.
Figure 9:
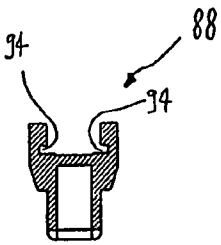
FIG. 9 is a sectional view along the line B-B of FIG. 7.
Figure 10:
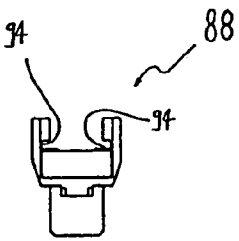
FIG. 10 is a view of the mounting of FIG. 7, as viewed in the direction of the arrow X.

In FIGS. 6 to 11, the mounting 88 of FIG. 5 is separately illustrated. FIG. 6 shows a perspective view of the mounting 88, FIG. 7 a longitudinal section and FIG. 8 is a top view thereof. FIG. 9 is a sectional view along the line B-B of FIG. 7, and FIG. 10 is a view of the mounting 88 as viewed in the direction of the arrow X of FIG. 7. The mounting 88 is made of plastic and has a first end 90 and a second end 92. When the mounting 88 is installed in the printer or copier, the first end 90 points to the outside. In the region of the first end 90, the support device 74 can be inserted into the mounting 88, the longitudinal edges of the support device 74 being inserted into longitudinal grooves 94 which are formed in the mounting 88 (see in particular FIGS. 9 and 10).

In the mounting 88, receptacles 96 for screws are formed, with which the mounting 88 is secured in the printer or copier.

Figure 11:
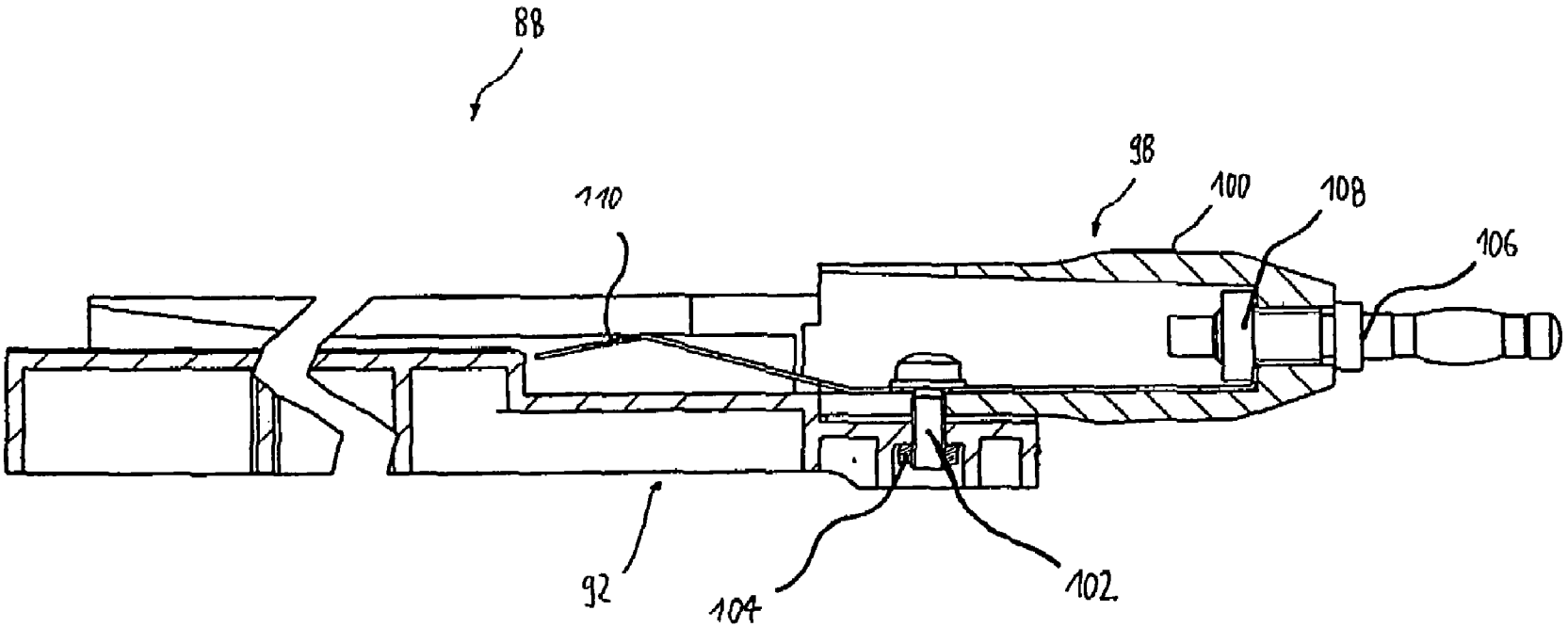
FIG. 11 is a sectional view of a portion of the mounting of FIGS. 6 to 10 and of a plug element mounted thereon.

FIG. 11 shows an enlarged sectional view of the second end 92 of the mounting 88. At the second end 92 of the mounting 88, a plug element 98 having a housing 100 is mounted with the aid of a screw 102 and a square nut 104. Further, a plug, for example a lamella plug 106, is secured to the housing 100 by means of a square nut 108. A spring 110 is conductively connected to the lamella plug 106 and arranged such that it comes into contact with the conductive support element 74 when the same is completely inserted into the mounting 88.

In the illustrated device, the mounting 88 with its plug element 98 is brought into plug connection with a further plug element (not shown) arranged in the printer or copier and is mounted and adjusted only once in the printer or copier (namely in the paper transport aggregate thereof). Since, as described above, the rubber lip 72 can compensate for considerable vertical tolerances, the adjustment does not have to be performed too exactly. When replacing or cleaning the contact element 34 no further adjustment is required. The contact element can easily be taken out of the mounting 88, be cleaned or replaced and again be inserted into the mounting 88 even by an untrained operator. Upon insertion in the mounting 88, an electrical contact is established between the conductive support element 74 and the plug element 106 via the spring 110. By means of this electrical contact, the voltage required for charging can be applied to the contact element 34.

With the structure described herein, the replacement or cleaning of the contact element 34 is considerably easier than with the structure known from the above-cited WO 2004/046830 A1, in which a support element having a plug element arranged thereon, which corresponds to the mounting 88 in the arrangement described herein, has to be taken out of the printer or copier as a whole so that the contact element can subsequently be replaced.

The preferred embodiment can advantageously be used in electrographic printing or copying devices whose recording methods for image formation are in particular based on the electrophotographic, magnetographic or ionographic recording principle. Further, the printing or copying devices can make use of a recording method for image formation in which an image recording medium is electrically controlled point-by-point either directly or indirectly. The preferred embodiment is, however, not restricted to such electrographic printing or copying devices.

Although in the drawings and in the preceding description a preferred embodiment has been illustrated and described in every detail, this is to be considered as being merely exemplary and as not restricting the invention.

I claim as my invention:

1. A device for electrically charging a transport belt for transport of recording media in a transfer printing area of an electrographic printer or copier, comprising:

in a direction transverse to a running direction of the transport belt a contact element is arranged bearing against the transport belt and via which electric charge is transferred onto the transport belt;

the contact element comprising a contact lip substantially comprising a rubber material and bearing against the transport belt;

the contact lip having a chamfered edge or a rounded edge in a region where it bears against the transport belt; and the transport belt together with a photoconductor forming a nip area in which it bears against the photoconductor, and in which the contact lip is arranged such that it contacts the transport belt in a front half of the nip area which half lies upstream with respect to the running direction of the transport belt.

2. A device according to claim 1 in which the contact lip is inclined at an angle against the running direction of the transport belt.

3. A device according to claim 2 in which the angle of inclination between the contact lip and the transport belt amounts to 15° to 45°.

4. A device according to claim 1 in which the rounded edge has a radius of curvature of 0.3 mm to 0.8 mm.

5. A device according to claim 1 in which the rubber material has a hardness which amounts to 35 to 55 ShoreA.

6. A device according to claim 1 in which the rubber material comprises a synthetic rubber.

7. A device according to claim 1 in which conductive particles for lowering a specific volume resistivity of the material are added to the rubber material, so that the specific volume resistivity amounts to $10^4$ to $10^9$ Ωcm measured when a voltage of 1000 volts is applied.

8. A device according to claim 1 in which the contact element comprises a conductive support element, and in which the contact lip has a mounting section for mounting on the support element, and a contact section for contact with the transport belt during operation.

9. A device according to claim 8 in which between the mounting section and the contact section the contact lip has an electrical resistivity of 1 to 10 MΩ measured at a current flow of 100 μA.

10. A device according to claim 8 in which longitudinal ends of the contact section protrude beyond the mounting section.

11. A device according to claim 8 in which the contact lip is glued with at least part of its mounting section or with its mounting section to the conductive support element by a conductive adhesive.

12. A device according to claim 8 in which the contact lip is secured with at least part of its mounting section or with its mounting section to the conductive support element by vulcanization.

13. A device according to claim 8 in which a clamping structure for clamping the contact lip is formed on the conductive support element, and by use of the clamping structure at least part of the mounting section or the mounting section of the contact lip can be clamped.

14. A device according to claim 8 in which a hollow profile section is formed on the conductive support element, and the mounting section of the contact lip is formed such that it can be inserted into the hollow profile section.

15. A device according to claim 8 which comprises a mounting arranged in the printer or copier, wherein the conductive support element can be inserted into the mounting arranged in the printer or copier, or can be pulled out thereof.

16. A device according to claim 15 in which the mounting has an electrical contact with which the conductive support element electrically comes into contact when it is inserted into the mounting.

17. A device according to claim 15 in which the conductive support element has a section which is formed of a sheet metal, and the mounting is provided with grooves for engagement with longitudinal edges of the sheet metal section when the conductive support element is inserted into the mounting.

18. A device according to claim 1 in which the transport belt is moved at a circulation speed of at least 0.3 m/s.

19. A transfer printing area of an electrographic printer or copier, comprising:

a transport belt for transport of recording media;

a photoconductor in contact with the recording media at the transfer printing area;

a device which electrically charges the transport belt, said device comprising in a direction transverse to a running direction of a transport belt a contact element arranged bearing against the transport belt and which electric charge is transferred onto the transport belt, the contact element comprising a contact lip substantially comprising a rubber material and bearing against the transport belt, and the contact lip having an edge in a region which bears against the transport belt; and the transport belt together with the photoconductor forming a nip area in which it bears against the photoconductor, and in which the contact lip is arranged such that it contacts the transport belt in a front half of the nip area which half lies upstream with respect to the running direction of the transport belt.

20. A contact element suitable for charging a transport belt for transport of recording media in a transfer printing area of an electrographic printer or copier, comprising:

a contact lip which is substantially comprised of a rubber material;

the contact lip having a chamfered edge or a rounded edge; and the rounded edge having a radius of curvature of 0.3 mm to 0.8 mm.

21. A contact element according to claim 20 in which the rubber material has a hardness which amounts to 35 to 55 ShoreA.

22. A contact element according to claim 20 in which the rubber material is comprised of a synthetic rubber.

23. A contact element according to claim 20 in which conductive particles for lowering a specific volume resistivity of the material are added to the rubber material so that the specific volume resistivity amounts to $10^4$ to $10^9$ Ωcm, measured when a voltage of 1000 volts is applied.

24. A contact element according to claim 20 which comprises a conductive support element, and in which the contact lip has a mounting section for mounting on the support element, and a contact section which is adapted for contact with the transport belt during operation.

25. A contact element according to claim 24, in which between the mounting section and the contact section the contact lip has an electrical resistivity of 1 to 10 MΩ, measured at a current flow of 100 μA.

26. A contact element according to claim 24 in which longitudinal ends of the contact section protrude beyond the mounting section.

27. A contact element according to claim 24 in which the contact lip is glued with at least part of its mounting section or with its mounting section to the conductive support element by a conductive adhesive.

28. A contact element according to claim 24 in which the contact lip is mounted with at least part of its mounting section or with its mounting section to the conductive support element by vulcanization.

29. A contact element according to claim 24 in which a clamping structure for the contact lip is formed on the conductive support element, and with the clamping structure at least part of the mounting section or the mounting section of the contact lip can be clamped.

30. A contact element according to claim 24 in which a hollow profile section is formed on the conductive support element, and the mounting section of the contact lip is formed such that it can be inserted into the hollow profile section.

31. A method for electrically charging a transport belt for transport of recording media in a transfer printing area of an electrographic printer or copier, comprising the step of:

in a direction transverse to a running direction of the transport belt arranging a contact element bearing against the transport belt and via said contact element electric charge is transferred onto the transport belt, the contact element comprising a contact lip substantially comprising a rubber material and which bears against the transport belt, and the contact lip having a chamfered edge or a rounded edge in a region where it bears against the transport belt;

wherein the contact lip is inclined against a running direction of the transport belt; and wherein an angle of inclination between the contract lip and the transport belt amounts to 15° to 45°.

32. A method for electrically charging a transport belt for transport of recording media in a transfer printing area of an electrographic printer or copier, comprising the step of:

in a direction transverse to a running direction of the transport belt arranging a contact element bearing against the transport belt and via said contact element electric charge is transferred onto the transport belt, the contact element comprising a contact lip substantially comprising a rubber material and which bears against the transport belt, and the contact lip having a chamfered edge or a rounded edge in a region where it bears against the transport belt; and wherein the transport belt together with a photoconductor forming a nip area in which it bears against the photoconductor, and the contact lip being arranged such that it contacts the transport belt in a front half of the nip area which half lies upstream with respect to the running direction of the transport belt.

33. A device for electrically charging a transport belt for transport of recording media in a transfer printing area of an electrographic printer or copier, comprising:

in a direction transverse to a running direction of the transport belt a contact element is arranged bearing against the transport belt and via which electric charge is transferred onto the transport belt;

the contact element comprising a contact lip substantially comprising a rubber material and bearing against the transport belt;

the contact lip having a chamfered edge or a rounded edge in a region where it bears against the transport belt;

the contact lip being inclined at an angle against the running direction of the transport belt; and the angle of inclination between the contact lip and the transport belt amounting to 15° to 45°.

34. A device for electrically charging a transport belt for transport of recording media in a transfer printing area of an electrographic printer or copier, comprising:

in a direction transverse to a running direction of the transport belt a contact element is arranged bearing against the transport belt and via which electric charge is transferred onto the transport belt;

the contact element comprising a contact lip substantially comprising a rubber material and bearing against the transport belt;

the contact lip having a chamfered edge or a rounded edge in a region where it bears against the transport belt; and the rounded edge having a radius of curvature of 0.3 mm to 0.8 mm.

* * * * *